US006755008B2

(12) United States Patent
Schmetzer et al.

(10) Patent No.: US 6,755,008 B2
(45) Date of Patent: Jun. 29, 2004

(54) METHOD AND APPARATUS FOR THE PACKAGING OF ARTICLES

(75) Inventors: Dietmar Schmetzer, Michelbach/B. (DE); Klaus Griessmayr, Rosengarten (DE)

(73) Assignee: Optima Filling and Packaging Machines GmbH, Schwaebisch Hall (DE)

( * ) Notice: Subject to any disclaimer, the term of this patent is extended or adjusted under 35 U.S.C. 154(b) by 0 days.

(21) Appl. No.: 10/038,778

(22) Filed: Jan. 3, 2002

(65) Prior Publication Data

US 2002/0124533 A1 Sep. 12, 2002

(30) Foreign Application Priority Data

Jan. 4, 2001 (DE) ..... 101 00 487

(51) Int. Cl.[7] ..... B65B 1/24; B65B 1/04

(52) U.S. Cl. ..... 53/438; 53/436; 53/469; 53/479; 53/529; 53/571; 53/284.7

(58) Field of Search ..... 53/436, 438, 439, 53/468, 469, 479, 529, 530, 571, 572, 255, 284.7, 385.1

(56) References Cited

U.S. PATENT DOCUMENTS

| | | | | | |
|---|---|---|---|---|---|
| 3,228,171 A | | 1/1966 | Cory | | |
| 3,508,379 A | * | 4/1970 | Noyes et al. | ..... | 53/572 |
| 3,619,976 A | | 11/1971 | Kerker | | |
| 3,810,344 A | | 5/1974 | Evans | | |
| 3,903,675 A | * | 9/1975 | Plumb | ..... | 53/572 |
| 4,037,388 A | * | 7/1977 | Bastasch | ..... | 53/572 |
| 4,047,362 A | * | 9/1977 | Lister et al. | ..... | 53/572 |
| 4,183,194 A | * | 1/1980 | Lucke | ..... | 53/571 |
| 4,242,854 A | | 1/1981 | Nissen | | |
| 4,492,070 A | | 1/1985 | Morse | | |
| 4,756,141 A | | 7/1988 | Hirsch | | |
| 5,056,300 A | * | 10/1991 | Suzuki et al. | ..... | 53/572 |
| 5,228,275 A | * | 7/1993 | Formo | ..... | 53/572 |
| 5,950,404 A | | 9/1999 | Meyer et al. | | |

FOREIGN PATENT DOCUMENTS

| | | |
|---|---|---|
| DE | 6800717 | 2/1969 |
| EP | 0 816 235 A1 | 1/1998 |
| EP | 01 13 0784 | 3/2002 |

* cited by examiner

*Primary Examiner*—John Sipos
*Assistant Examiner*—Louis Huynh
(74) *Attorney, Agent, or Firm*—Quarles & Brady LLP

(57) ABSTRACT

An apparatus and a method for packaging articles in bags is proposed, where a packaging magazine is used for receiving and guiding an article to be packaged. An article to be packaged is slid by a slider into the packaging magazine. The packaging magazine then moves together therewith into an opened bag, which is removed from a bag stack. With the bag, which surrounds the packaging magazine, the latter is then slid into the transfer magazine from where further conveying takes place.

17 Claims, 8 Drawing Sheets

METHOD AND APPARATUS FOR THE PACKAGING OF ARTICLES

TECRNICAL FIELD

The invention relates to an apparatus and a method for the packaging of articles in bags.

DESCRIPTION OF THE BACKGROUND ART

In a known apparatus for the packaging of articles (EP 816 225) alternately acting sliders are present, which are moved backwards and forwards. During the rearwards movement in each case one slider is moved out of the path of the other slider. The slider movement is freely programmable (slider insertion and removal positions, slider strokes, movement profiles).

The articles to be packaged can in many cases be stacks of flat objects. As a result of the nature of the packaging with laterally inserted side folds, with respect to the packaging cross-section one is bound to specific geometrical conditions. The pack cannot be higher than it is wide. This circumstance exists with products having a limited content.

The flat objects are supplied vertically as a result of the design of the apparatuses with which said flat individual objects are finished. If there is a drop below the height/width ratio in the pack, the articles must be placed horizontally. The objects are frequently compressed articles, e.g. slip inserts, cleaning cloths or other fleecy or fluffy products.

For reducing the packaging volume and for improving the appearance of the finished pack, said formations have to be compressed.

The problem of the invention is to propose a method and an apparatus for the packaging of articles in bags, which operates with considerable reliability and provides the possibility of reducing the effects of disturbances.

SUMMARY OP THE INVENTION

To solve this problem the invention proposes an apparatus and a method having the features described below.

The invention is incorporated in an apparatus that uses a slider, which as the upper slider is fixed to a revolving chain. Therefore, the slider is not moved backwards and forwards and instead moves along a closed path, the return path taking place at a different height. The product slider sliding path is fixed. The slider initially brings the article to be packed into the filling magazine, from where the article is brought into the bag station. From there it is brought to the sealing station with the aid of the accompanying magazine.

In the transfer station the filled bag can in this way be carefully conveyed, without the pack being influenceable by slots, slits or other projections.

According to a further development of the invention, the packaging magazine is arranged and constructed in such a way that the slider in the infeed position can slide an article to be packed into the magazine.

According to a further development, the packaging magazine is movable in such a way that it moves together with the article to be packed into an opened bag and is left standing there in the transfer position. Thus, the sliding in of the article to be packed takes place with it still located in the packaging magazine. Thus, also here the article can be guided and therefore protected by the packaging magazine. The packaging magazine can have smooth side walls, a smooth bottom and also a smooth top side with a slot for the slider. Optionally an air cushion can also be formed.

According to a further development of the invention, the movement path of both magazines can overlap. Therefore the transfer magazine can be moved to a point where the packaging magazine can also be located, but there is no need for a complete overlap of both magazines.

According to another further development of the invention, the two magazines can be simultaneously in the transfer position and can consequently also overlap. As a result there can be a careful transfer with a limited lateral clearance of the filled bag from the packaging magazine into the transfer magazine. In the position where both magazines are moved out of the transfer position, they have such a mutual spacing that the bag station can open a bag unhindered by the magazines.

The overlap can e.g. result from the fact that the transfer magazine has a somewhat greater width and height than the packaging magazine, so that the latter can partly move into the transfer magazine. This construction is preferred, even though a reverse construction is also possible.

According to another further development of the invention, in the sealing position the transfer magazine can be positioned in such a way that the slider has slid the packed article through the sealing jaws of a sealing station.

According to a further development of the invention, the transfer magazine can be constructed in such a way that it guides the filled bag during its movement to the sealing station. This guidance can take place through smooth side walls, a smooth, flat bottom and a smooth top side. It can in particular be provided that the bottom and the side walls, together with the magazine, are guided over and beyond any gaps, slots or other parts of the sealing station, so that the filled bag cannot stick or be held up at any point. The filled bag is then stopped at a point beyond any gaps, whereas the slider and the transfer magazine are then moved back. The bag with its content is then located on the opposite side of the sealing jaws. The joining of the still open bag can then take place with the aid of the welding jaws or dies. It is also possible to produce an air cushion, also on sliding the bag out of the transfer magazine, in order to simplify or aid the sliding out process.

According to another development of the invention, during its movement in the conveying direction, the transfer magazine is moved more slowly than the slider, so that during the entire transfer magazine movement it moves the filled bag through the magazine.

The invention is particularly advantageous if the article to be packaged is a compressible article, which is slid into the bag under a certain tension. This tension is to be maintained. It can in particular be a stack of objects, where also the gaps between the objects are to be compressed.

In the description up to now reference has been made to a single slider. It is obviously appropriate for there to be several sliders on the revolving mechanism in order to increase the output of the apparatus.

If the articles to be packed are stacks of fluffy objects, according to the invention a row of juxtaposed, vertically positioned objects is formed. As soon as the collecting magazine is filled, it is pivoted from the filling position into the emptying position, where the objects rest flat on one another. They are compressed by the compressing device, which constitutes a type of precompression. The air between the individual objects and the air within said objects is displaced. In said compressed position the stack can be removed from the rotary magazine.

According to a further development of the invention, the compressing device has a displaceable pressure wall, which is placed approximately parallel to the flat sides of the objects and is movable perpendicular to said flat sides. Thus, in the filling position the pressure wall is parallel to a side wall, whereas in the emptying position it is parallel to the bottom, because during pivoting the magazine changes its orientation in the same way, e.g. by 90°. What was originally a side wall, becomes the bottom or top in the emptying position.

In a further development of the invention compression takes place during the pivoting of the collecting magazine. This can e.g. take place in that the movement of the pressure wall takes place in forcibly controlled manner, e.g. by a cam, a curved guide or the like.

However, it is also possible for the movement of the pressure wall and therefore the compression of the flat objects to take place with the aid of a servomotor, which is then also preferably forcibly controlled, e.g. by an electronic control.

The drive for the pivoting device can preferably also have a servomotor, in order to precisely control the residence of the magazine in each of the two positions.

The invention more particularly proposes that the apparatus has several magazines. It can e.g. be the case that one of the several magazines is in the filling position and a second magazine is in the emptying position.

According to a further development of the invention, the emptying of one magazine and the filling of another magazine can take place simultaneously. For this purpose the positions can be so displaced from a line that the two positions do not interfere with one another.

According to the invention, the pivoting device can pivot in reciprocating manner the collecting magazine or the several collecting magazines.

It is also possible and is proposed by the invention, that the pivoting device is constructed in such a way that it gradually rotates in one direction the at least one collecting magazine.

The method proposed by the invention proceeds in the following way. An article to be packed is slid into a packaging magazine. The packaging magazine together with the article located therein is moved into an opened bag. During this movement optionally it is possible to displace the article with respect to the packaging magazine. The packaging magazine can e.g. be slid into the bag to such an extent that its front side in the conveying direction comes onto the bottom of the bag. The object is slid into the bag by the magazine. The filled bag is then transferred into the transfer magazine and the packaging magazine is extracted from the bag. In the transfer magazine the filled bag is slid to a sealing station where it is sealed.

According to a further development of the invention the packaging magazine is reciprocated between an infeed position and the transfer position.

A revolving slider is used for sliding the article and preferably several revolving sliders are arranged in succession.

The transfer magazine is moved backwards and forwards between the acceptance position and the sealing station.

According to a further development, the transfer magazine is moved more slowly in the conveying direction than the filled bag. As a result the filled bag is moved through the transfer magazine, i.e. is slid.

During the movement of the filled bag the latter is guided on all sides, so that at no point can it stick.

The packaging magazine and the transfer magazine can be simultaneously located at the acceptance position.

If the articles to be packed are stacks of fluffy, flat objects, which are delivered in the vertical position, the invention proposes that these vertical objects be arranged in juxtaposed form for forming a stack and after the formation of the stack pivoting takes place in such a way that the flat objects rest on one another. The stack is then compressed in that the flat sides of the outer objects are moved towards one another. The thus formed compressed and horizontally positioned stack can then undergo further packaging.

The invention proposes that the stack is compressed after the start of pivoting and prior to stack removal.

The invention more particularly proposes that the stack be compressed during pivoting and preferably during the entire pivoting process.

Compression can take place in that a pressure wall is located in the magazine, which at the start of compression is positioned laterally and during magazine pivoting changes its position together with the magazine, so that at the end of pivoting it forms the magazine bottom.

According to the invention simultaneously two stacks can be formed in each magazine.

BRIEF DESCRIPTION OF THE DRAWINGS

Further features, details and advantages of the invention can be gathered from the following description of a preferred embodiment of the invention and the attached drawings, wherein show.

DETAILED DESCRIPTION

Figure 1:
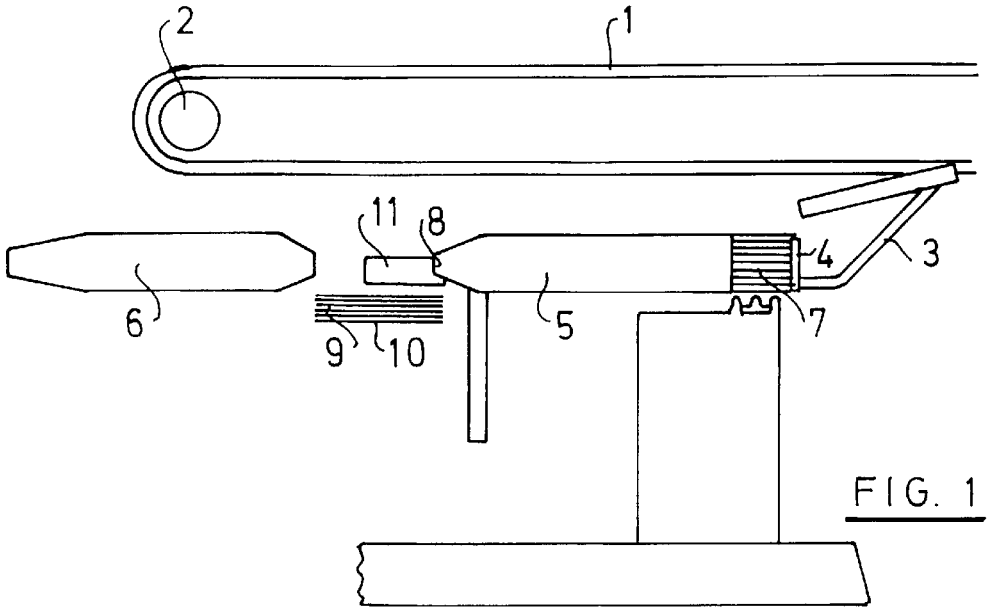
FIG. 1 A schematic representation of important parts of the apparatus proposed by the invention for illustrating the method of the invention.

The apparatus proposed by the invention contains a revolving chain 1, which is guided round two parallel sprockets 2 and is continuously driven. FIG. 1 only shows the left-hand end of such an apparatus. To the chain 1 is fixed a plurality of arm members 3, which have at their free end a slider plate 4, referred to hereinafter as a slider. With the chain 1 revolving, the sliders 4 move along the lower strand in the horizontal direction up to the end of the chain 1.

Figure 2:
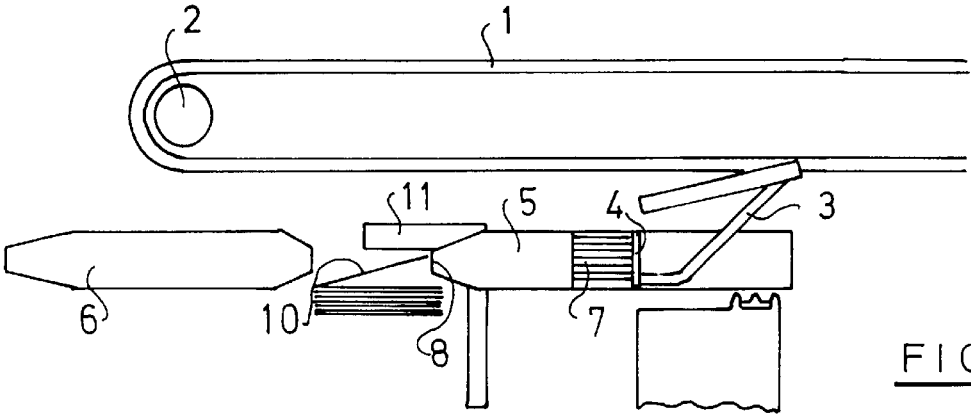
FIG. 2A schematic representation corresponding to FIG. 1 at a later time.
Figure 3:
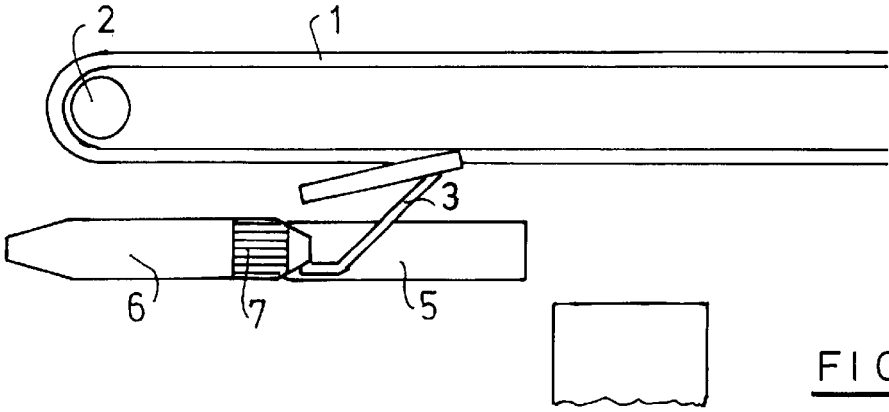
FIG. 3 A schematic representation corresponding to FIG. 2 at a yet later time.

Below the conveying means having the sliders 4 are horizontally displaceably arranged two magazines 5, 6. The displacement direction corresponds to the movement direction of slider 4 and therefore the conveying direction of the apparatus. Magazines 5, 6 have a similar construction. Further details will be given hereinafter in connection with FIGS. 5 to 7. With the aid of a not further illustrated device a stack 7 of articles to be packed are made ready at a given point. At this time the right-hand magazine in FIG. 1 is in its infeed position. Magazine 5 is referred to as the packaging magazine. The slider 4 slides the stack 7 into the packaging magazine 5. At the opposite end 8, which is the front end in the conveying direction, a stack 9 of bags 10 is positioned upstream of the packaging magazine 5. The bag station is constructed in such a way that with the aid of an opener 11 the in each case top bag 10 of the stack 9 can be opened. This opening movement of the opener 11 is not hindered by the two magazines 5, 6, because they have a corresponding mutual spacing. Following the opening of the top bag 10 by the bag opener 11, cf. FIG. 2, the packaging magazine 5 with the already slid in stack 7 is moved in the conveying direction, i.e. from right to left in FIG. 2. As a result the packaging magazine 5 completely enters the bag 10. The stack 7 of articles is also slid onto the bottom of bag 10. This state is illustrated in FIG. 3. As soon as the stack 7 has been slid into the bag and the latter clings to the stack 7, the second magazine 6, referred to as the transfer magazine, is moved counter to the conveying direction until the two magazines longitudinally overlap and the stack 7 is slid with the aid of slider 4 into the transfer magazine 6. This state is illustrated in FIG. 3.

As from now the transfer magazine 6 is again moved in the conveying direction and simultaneously slider 4 is moved on. Slider 4 moves at a higher speed than the transfer magazine 6 and as a result the stack 7 is longitudinally slid through the transfer magazine 6.

Figure 4:
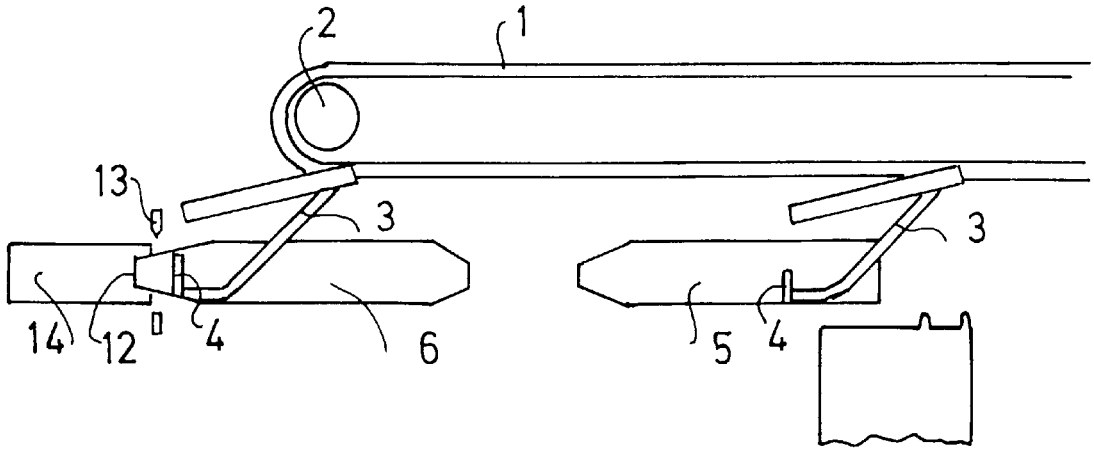
FIG. 4 Another schematic representation at a yet later time.

The transfer magazine 6 is moved into a position where its front end in the conveying direction has slid between the welding jaws 13 of a sealing station. In this way the stack 7 is slid through the welding jaws 13 and arrives there in an intermediate station 14, where it is held on either side from the top and the bottom. During sliding through the welding jaws 13 the stack in its bag rests on a bottom of the transfer magazine 6, so that it cannot stick or stop in any gaps of the welding station. This state is illustrated in FIG. 4.

Due to the fact that the slider arm has moved upwards around the reversing point 2, the slider is now retracted. The transfer magazine 6 is now again moved counter to the conveying direction and as a result it passes out of the space between the two welding jaws 13. The welding jaws 13 can now be moved towards one another in order to weld the bag.

The apparatus proposed by the invention has the following advantages. By reducing disturbances and forced disconnections in the case of high cycle numbers and with a multitrack packaging process the machine availability is increased. Product inspection is improved, particularly if loose, single products have not been slid into a bag. The finished pack has an improved appearance.

The sliding path of the products relative to the side walls is reduced by the joint movement of the product guidance channels, namely the magazines. Particularly the transitions and abutting edges over which the product is slid are reduced. For further reducing friction between the product and the walls of the magazines, it is possible to form an air cushion.

The gap present between the packaging magazine 5 and the transfer magazine 6, cf. FIGS. 1 and 4, can be used for the unhindered opening of a bag.

Figure 5:
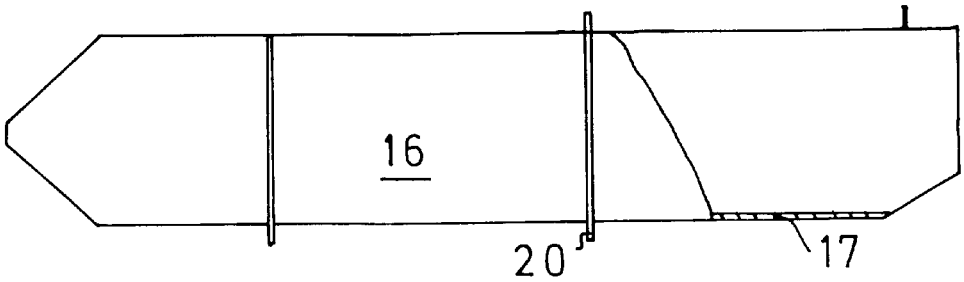
FIG. 5 A side view of a transfer magazine.
Figure 6:
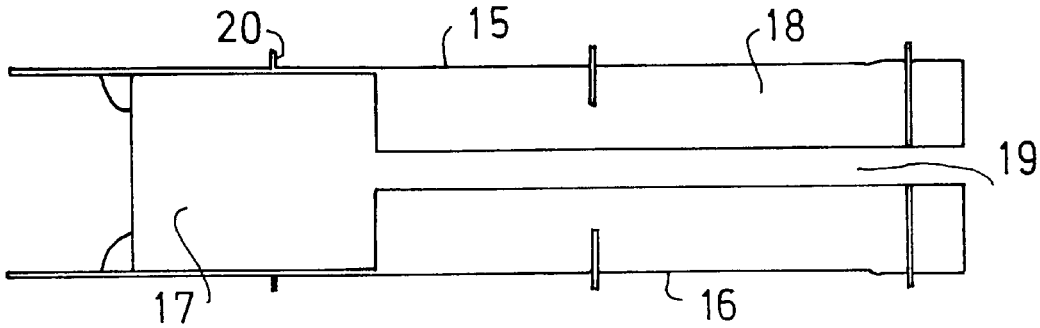
FIG. 6 A plan view of the transfer magazine of FIG. 5.
Figure 7:
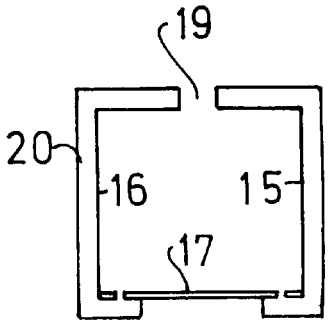
FIG. 7 A front view of a transfer magazine from the right in FIG. 5.

The shape and action of the magazines will now be illustrated further with reference to FIGS. 5 to 7, the two magazines having a similar construction. The magazines contain two side walls 15, 16 in the form of planar walls. At least on the inside thereof, they have a smooth surface. The magazines also have a bottom 17, which also has a smooth surface. The bottom 17 can also be inserted and can be displaced on lateral guides.

Over part of the length the magazine also has a top side 18 carrying a narrow slit 19. This slit 19 extending in the longitudinal direction of the magazine permits the passage of the arm member 3 of slider 4. To increase stiffness the magazine has on its outside reinforcing ribs 20, cf. also FIG. 7.

Figure 8:
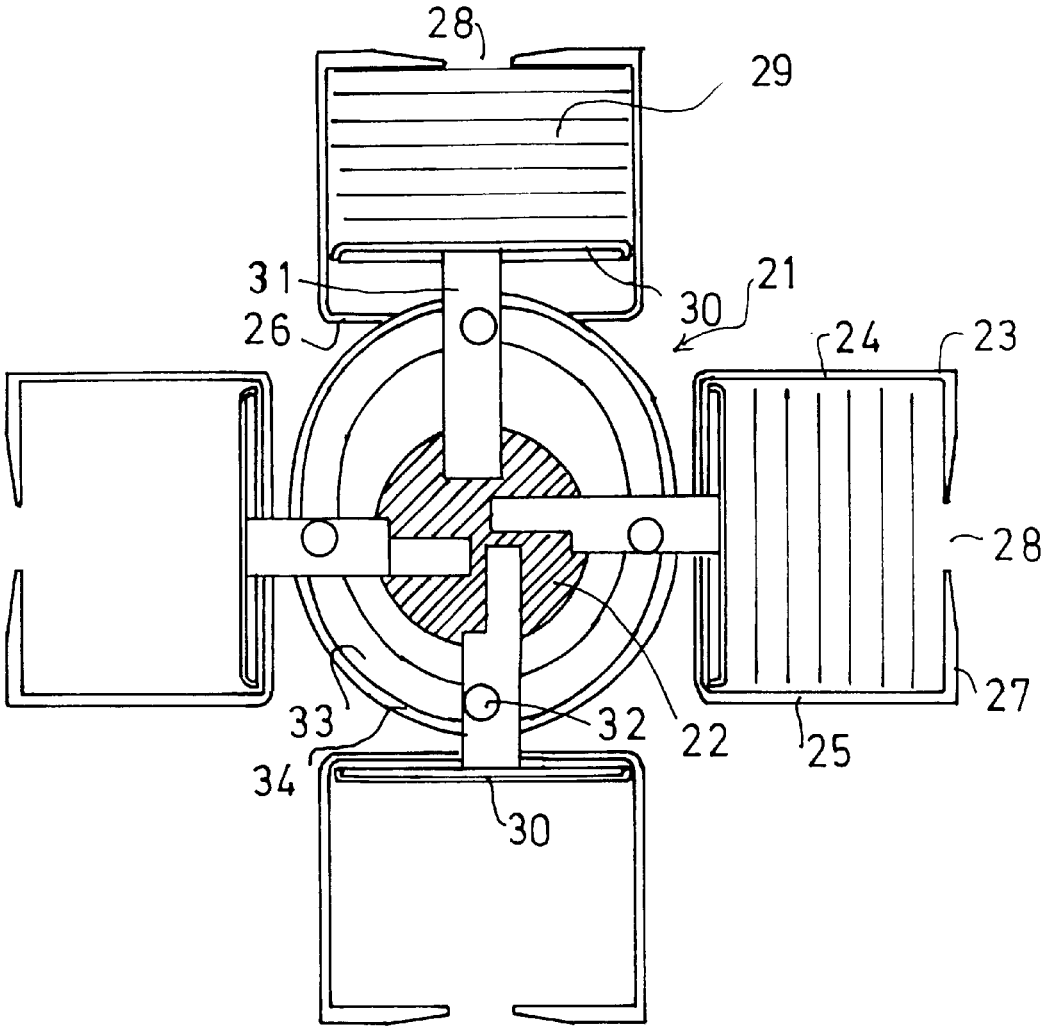
FIG. 8 A front view of a device for forming compressed stacks.

In FIG. 1 it is assumed that the article to be packed, namely a stack of flat, horizontal objects has already been formed. The following drawings deal with the possibility of forming such a stack from fluffy objects. FIG. 8 shows a possibility for transforming the vertically delivered, fluffy objects into flat, horizontal stacks. The apparatus contains a pivoting device 21, which has a central shaft 22 rotatable by a servomotor. Four collecting magazines 23 are rigidly fixed to the shaft 22, without this being shown in detail in the drawing. The rigid fixing can also be such that the magazines 21 can be replaced. It is important that the magazines 23 (with elements 24, 26, 27, 25) can be rotated together with the shaft 22 without changing their position or spacing relative to the shaft.

The magazines have two side walls 24, 25 interconnected by a bottom 26. The top side 27 facing the bottom 26 has a slot 28, which extends longitudinally perpendicular to the paper plane. The magazines 23 are constructed as front and rear-open, parallelepipedic containers.

The right-hand magazine 23 in FIG. 8 is in the filling position. The only intimated objects 29 are delivered in vertically grouped manner with a vertical positioning by the preceding machine and are slid into the magazine 23. The shaft 22 is then rotated by 90° by a servomotor. As a result the magazine passes into the upper position used for sliding the stack of articles 29 out of the magazine. The longitudinal slot 28 is used for sliding out using the slider.

All the magazines 23 contain a pressure wall 30 parallel to the bottom 26. The pressure wall 30 is displaceably guided in such a way that it always remains parallel to the bottom 26. the nature of the guidance is not shown in detail. The pressure wall 30 has a tongue 31 connected thereto and which can e.g. be used for guiding the pressure wall 30. To the tongue 31 is fitted a roll 32, which engages in the groove 33 of a disk cam 34. The disk cam and the groove 33 are in the form of an oval. The disk cam 34 is arranged in fixed standing manner and consequently does not rotate with the shaft 22. On rotating the magazines 23 with the aid of the shaft 22, the rolls 32 slide in the groove 33 and consequently follow the shape of the groove. Thus, during the pivoting from the right-hand into the upper position, the pressure wall 30 is moved radially outwards and is shown in the upper position in FIG. 8. This radial outward movement represents a compression of the stack of articles 29 in a direction perpendicular to the flat sides of said articles 29. In the emptying position, at the top in FIG. 8, the stack of articles is compressed. It can be slid out in this way, so as to e.g. be further packaged by an apparatus shown in FIGS. 1 to 7.

Figure 9:
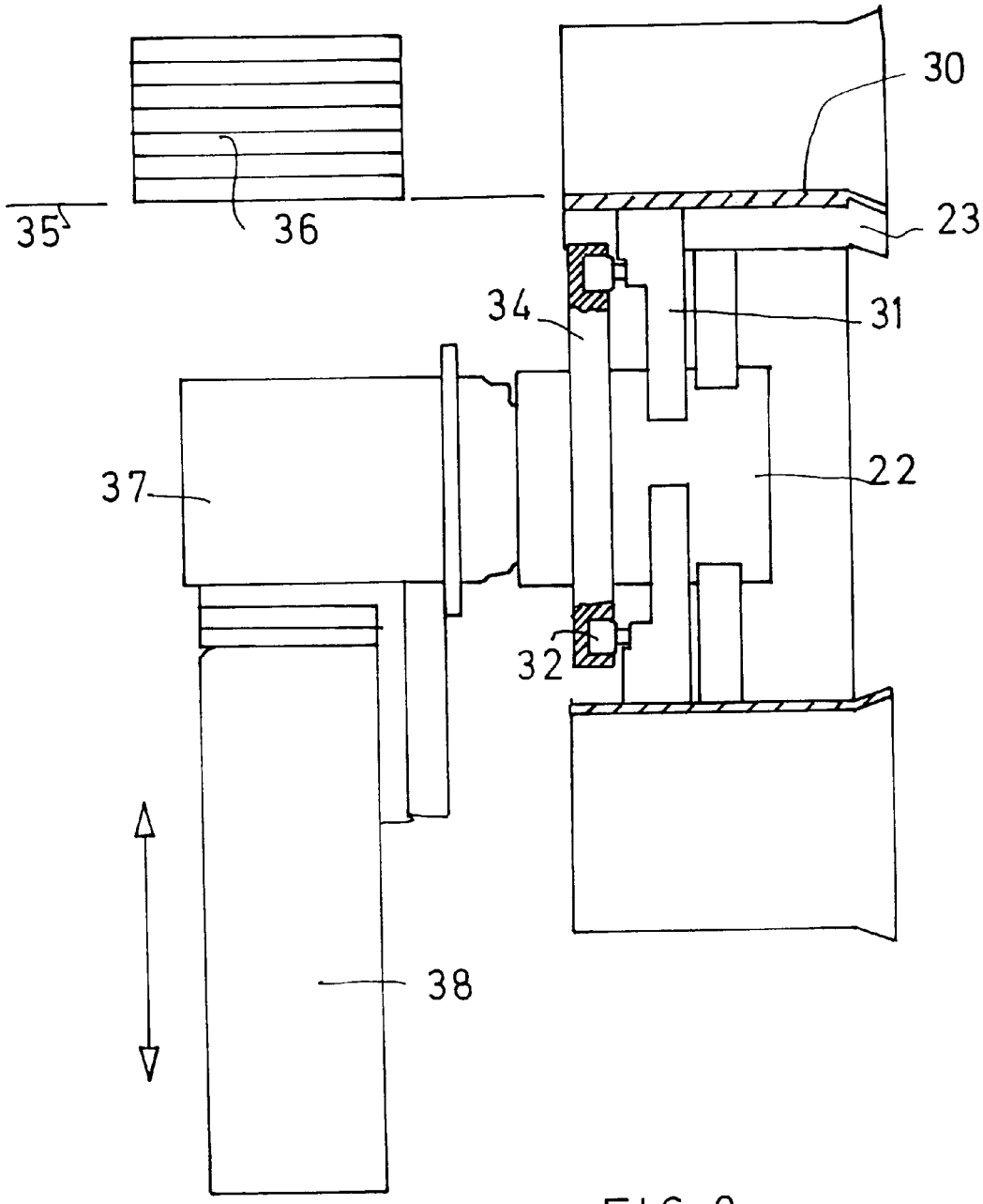
FIG. 9 A side view of the arrangement of FIG. 8.

FIG. 9 shows a side view of the apparatus of FIG. 8. The upper magazine 23 is in the emptying position, the individual parts being so matched to one another that the pressure wall 30, now forming the bottom, is at the same height as a surface 35 along which the stack 36 formed is to be slid. The insertion sides of the magazines 23, to the left in FIG. 9, are widened somewhat in order to facilitate article insertion.

The complete arrangement, including the servomotor 37, can be raised or lowered with the aid of a lifting unit 38. As a result the apparatus can be adapted to different product heights (format adaptation).

Figure 10:
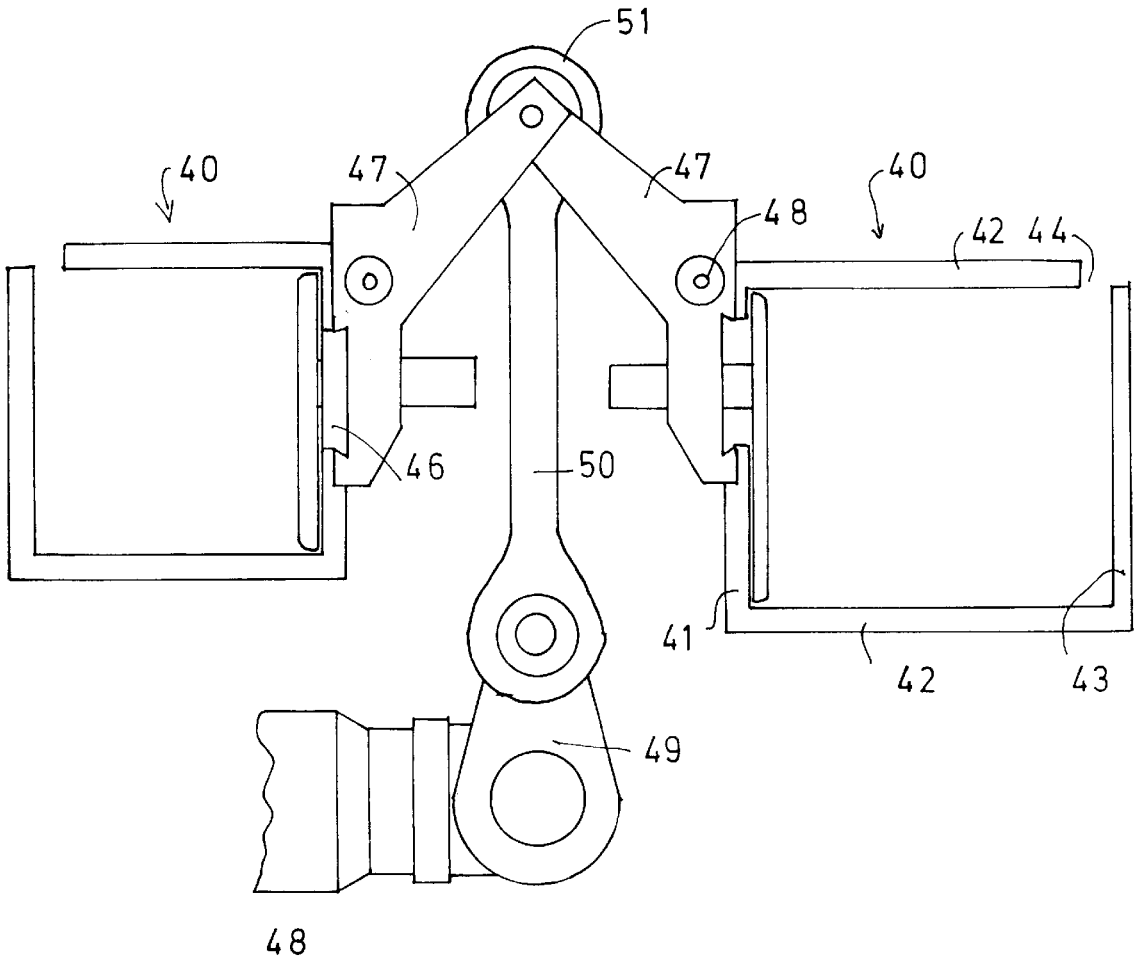
FIG. 10 A representation corresponding to FIG. 8 of a second device for forming a stack.

Whereas with the apparatus shown in FIGS. 8 and 9 the pivoting of the magazines 23 always takes place in a single direction, e.g. counterclockwise in FIG. 8, FIGS. 10 to 12 show a device in which the magazines are pivoted backwards and forwards. In FIG. 10 the two magazines 40 are in the filling position in which they are to be filled with the vertically standing, individual objects. As can be gathered from FIG. 10 the two magazines 40 are of different sizes. This device can be used for simultaneously loading two packaging lines. Once again a pivoting device is provided for pivoting the magazines 40 from the filling position shown in FIG. 10 into the emptying position shown in FIG. 11.

The parallelepipedic magazines contain a bottom 41, two side walls 42 and a top side 43. A longitudinal slot 44 is formed laterally in place of an edge between the side wall 42 and the top side 43.

Once again a pressure wall 45 is positioned parallel to the bottom 41 and which is in the same way displaceably guided parallel to itself within the magazine 40.

As can be gathered from FIG. 10, the magazines are slid into a mounting support with the aid of a tongue 46 and can consequently be removed. The mounting support is constructed in a double-armed lever 47, which can be pivoted about a fixed spindle 48. For pivoting purposes a pivoting device is provided, which contains a servomotor 48 as the drive. The servomotor 48 rotates an arm 49, whose rotation axis is perpendicular to the longitudinal axis of servomotor 48. To the end of arm 49 are articulated two hinge rods 50, whose other ends 51 are connected in articulated manner with in each case one of the two double-armed levers 47. In both FIG. 10 and FIG. 11 the two hinge rods 50 directly succeed one another, so that they cannot be distinguished.

If now the servomotor 48 is put into operation, arm 49 is rotated, which simultaneously leads to a change in the position of the hinge rods 50. The two double-armed levers 47 are pivoted in opposition to one another about the spindle 48. Thus, the two magazines, together with the levers 47 are brought into the position shown in FIG. 11, where the articles 29 are arranged in flat, horizontal manner.

The pressure wall 45 can be pivoted with the aid of a lever 52 about a spindle 53 different to the spindle 48 of the pivoting lever 47. The pivoting entrainment of the pressure wall 45 is brought about solely in that said wall 45 can only be moved linearly with respect to the magazines 40. As a result of the articulated arrangement about a different axis, there is a displacement of the pressure wall with respect to the bottom 41 of the magazines, so that also in this case there is a compression of the articles 29. In the emptying position the pressure wall 45 has a spacing from the bottoms 41 of the two magazines, whereas in the filling position it still rests on the bottoms 41.

Figure 11:
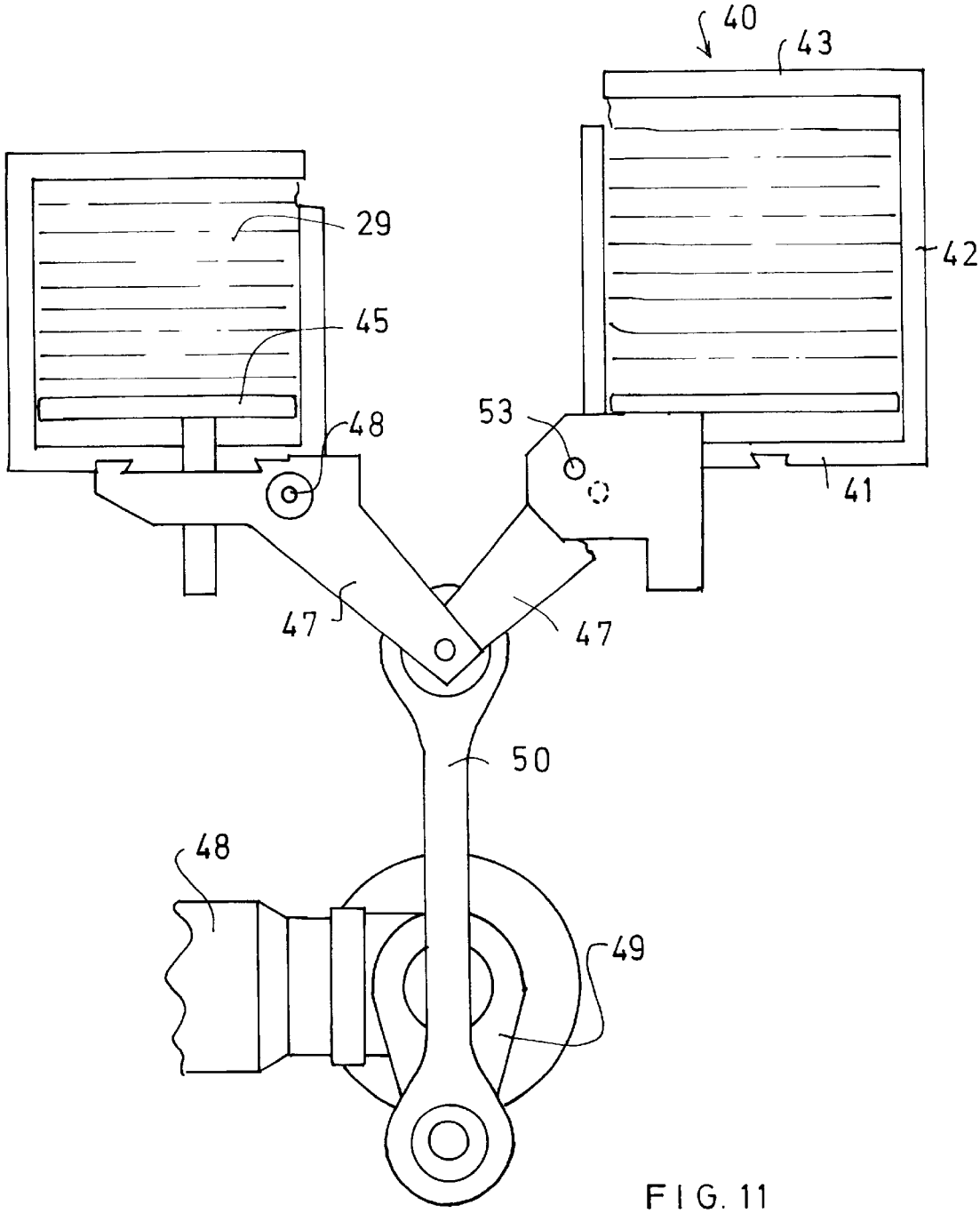
FIG. 11 A view of the device of FIG. 10 with the magazines pivoted.
Figure 12:
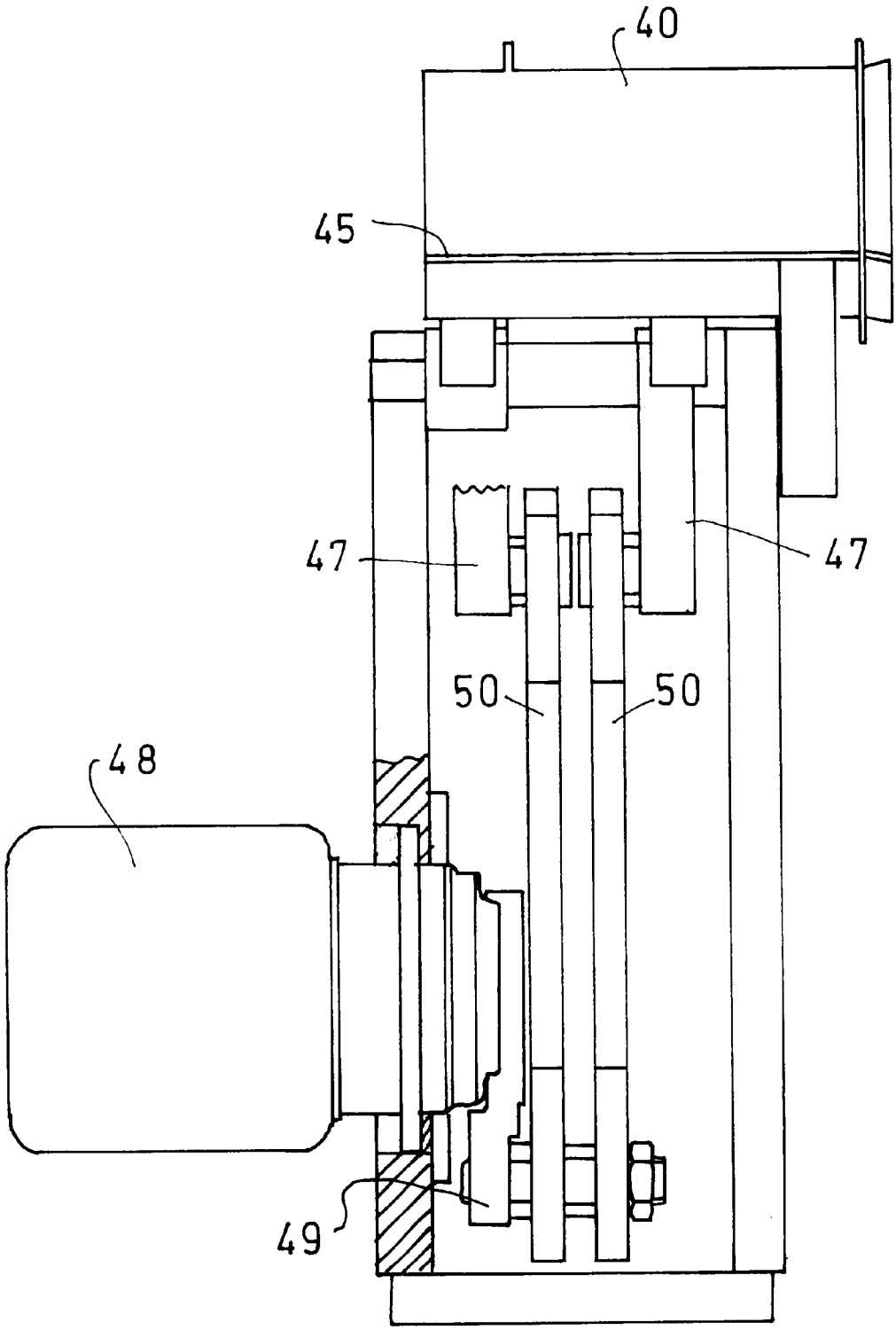
FIG. 12 A side view of the arrangement of FIGS. 10 and 11.

FIG. 1 shows a side view of the arrangement of FIGS. 10 and 11. It can be gathered from FIG. 12 that the two hinge rods 50 are present, one for each pivoting lever 47. Much as in the preceding embodiments it is possible to adjust the height of the overall arrangement, without this being shown in detail. The two hinge rods 50 are arranged in succession, so that they overlap both in FIGS. 10 and in 11. Their movement is derived from the same arm 49, so that they perform precisely the same movement if both hinge rods 50 have an identical construction.

What is claimed is:

1. Method for packing articles in bags (10), the method comprising:

moving an article into a packaging magazine (5) using at least one slider, wherein the packaging magazine comprises a pair of spaced apart side structures and a supporting surface for the article therebetween, moving the packaging magazine (5) together with the article into an opened bag (10), moving the article from the packaging magazine (5) into the bag 10, wherein a transfer magazine is positioned at a transfer position to receive the filled bag;

moving the filled bag (10) into the transfer magazine (6) using the slider, wherein the transfer magazine comprises a pair of spaced apart side structures and a supporting surface for the article therebetween, moving the transfer magazine with the filled bag therein towards a sealing station, moving the transfer magazine in a direction away from the sealing station so as to allow access to the bag, and sealing the bag to enclose the article.

2. Method according to claim 1, wherein the packaging magazine (5) is moved backwards and forwards between an infeed position and the transfer position.

3. Method according to claim 2, wherein a revolving slider (3, 4) is used for moving the article.

4. Method according to claim 3, wherein the transfer magazine (6) is moved backwards and forwards between the transfer position and the sealing station.

5. Method according to claim 4, wherein the transfer magazine (6) is moved more slowly in a conveying direction than the filled bag (10).

6. Method according to claim 5, wherein the filled bag (10) is guided on all sides during moving to the sealing station.

7. Method according to claim 6, wherein the packaging magazine (5) and transfer magazine (6) are simultaneously moved into the transfer position.

8. Method according to claim 7, wherein the packaging magazine (5) is at least partly moved into the transfer magazine, (6) in a transfer position.

9. Method according to claim 8, wherein the moving is accomplished by use of several successively positioned sliders (3, 4).

10. Method for packaging articles in bags according to claim 1, wherein moving an article into a packaging magazine further comprises positioning individual, flat objects (29) in a vertical position and placing said objects in an upright position for forming a pack, and further comprising pivoting the stack about a horizontal axis for forming a stack from the objects (29) resting on one another, further compressing the stack transversely to the flat sides of the objects (29) resting on one another, and wherein the compressed stack is packaged by moving the compressed stack into the bag (10), and sealing the bag to enclose, the compressed stack.

11. Method according to claim 10, wherein the stack is compressed after the start of pivoting and prior to stack removal.

12. Method according to claim 10, wherein the stack is compressed during pivoting.

13. Method according to claim 12, wherein the stack is formed in a magazine (23, 40) and the magazine is pivoted together with the stack.

14. Method according to claim 13, wherein the stack is compressed by the movement of a pressure wall (30, 45) of the magazine (23, 40).

15. Method according to claim 14, wherein simultaneously two stacks are formed in each case one magazine (40) and both stacks are simultaneously pivoted.

16. Method according to claim 15, wherein the magazine (40) is pivoted backwards and forwards.

17. Method according to claim 15, wherein the magazine (23) is gradually rotated in a constant direction.

* * * * *